US005598039A

United States Patent [19]

Weber

[11] Patent Number: 5,598,039

[45] Date of Patent: Jan. 28, 1997

[54] METHOD AND APPARATUS FOR SENSING STATE OF ELECTRIC POWER FLOW THROUGH A MASTER CIRCUIT AND PRODUCING REMOTE CONTROL OF A SLAVE CIRCUIT

[75] Inventor: Harold J. Weber, Holliston, Mass.

[73] Assignee: Touchstone Patent Trust, Holliston, Mass.

[21] Appl. No.: 31,322

[22] Filed: Mar. 15, 1993

[51] Int. Cl.[6] ..... G08B 1/00

[52] U.S. Cl. ..... 307/38; 307/140; 340/539; 340/825.69; 340/825.72

[58] Field of Search ..... 307/39, 40, 29, 307/38, 41, 114, 115, 116, 117, 132 M, 155, 24, 30, 125, 126, 31, 34, 11, 12, 139, 140; 340/326, 333, 538, 539, 310.01, 310.08, 825.06, 825.69, 825.72; 318/102; 323/318, 320; 299/30; 341/174, 176

[56] References Cited

U.S. PATENT DOCUMENTS

| | | | |
|---|---|---|---|
| 4,024,528 | 5/1977 | Boggs | 340/310.03 |
| 4,034,259 | 7/1977 | Schoch | 307/39 |
| 4,101,886 | 7/1978 | Grimes | 307/140 |
| 4,154,393 | 5/1979 | Darvishian | 340/569 |
| 4,200,862 | 4/1980 | Campbell | 340/825.69 |
| 4,223,301 | 9/1980 | Grimes | 307/140 |
| 4,523,193 | 6/1985 | Levinson | 340/326 |
| 4,659,941 | 4/1987 | Quiros et al. | 307/39 |
| 4,751,605 | 6/1988 | Mertz | 307/140 |
| 4,948,987 | 8/1990 | Weber | 307/36 |
| 5,081,534 | 1/1992 | Geiger et al. | 340/825.69 |
| 5,120,983 | 6/1992 | Samann | 307/38 |
| 5,239,205 | 8/1993 | Hoffman et al. | 307/117 |
| 5,462,225 | 10/1995 | Massara et al. | 307/39 |
| 5,475,369 | 12/1995 | Baker | 340/573 |

*Primary Examiner*—William M. Shoop, Jr.
*Assistant Examiner*—Peter Ganjoo

[57] ABSTRACT

Remote control of a slave electric circuit is produced by sensing change in state of power flow through a master electric circuit and transmitting a resultant wireless signal between apparatus included in each the master circuit and the slave circuit. In a representative embodiment, the master electric circuit might include a main lamp which can be switched on and off while the remote electric circuit may include a supplementary lamp which is to be controlled. A fundamental implementation is that of producing a distinctive electromagnetic wireless signal at the master circuit apparatus in immediate response to the sensed change in the state of power flow through the master electric circuit whereupon the signal may be transmitted to and remotely received by the slave electric circuit control apparatus and utilized to correspondingly change the immediate state of power flow through the slave circuit with the subsequent result that the slave electric circuit may remotely turn-on when the master electric circuit is locally turned-on and conversely the slave electric circuit may remotely turn-off when the master electric circuit is locally turned-off.

20 Claims, 11 Drawing Sheets

METHOD AND APPARATUS FOR SENSING STATE OF ELECTRIC POWER FLOW THROUGH A MASTER CIRCUIT AND PRODUCING REMOTE CONTROL OF A SLAVE CIRCUIT

FIELD OF MY INVENTION

My invention pertains to remote control of one or more functionally disparate electric circuits by a wireless signal originated from a master control device. More particularly the wireless signal is produced in response to power flow stimuli locally sensed by the master control device as a result of power flow which may typically be manually initiated through a primary load circuit. In usual form, my invention pertains to "plug-in" or "wired-in" adapter devices which might be included in electric circuits to attain immediate remote on and off control of a slave electric circuit in response to power flow state changes sensed in the primary load circuit by the master control device.

BACKGROUND OF INVENTION

Remote control of alternating current (a.c.) power flow through various circuits is a well known application of wireless or "carrier current" technology. Numerous major manufacturers make devices which have a master control which is usually provided as a pushbutton switch that activates a transmitter circuit which emits a uniquely keyed radio frequency signal (or in some cases, an infrared light pulse or ultrasonic signal) that may be received by a remote slave device. The slave device ordinarily is in the form of an adapter which regulates power flow to a remotely controlled load, such as a lamp. The unique character of the wireless control signal is that it may turn the controlled load on and off at the whim of an operator utilizing the master control device.

Leviton Manufacturing Co., Inc. (Little Neck, N.Y.) produces a line of DECORA[™] Electronic powerline coupled carrier current controls which includes the model 6319 controller and the model 6320 transmitter that function as manually operable units which send signals to a variety of remote receiver devices including the model 6381 and 6291 switch modules and model 6227, 6280, 6295 and 6296 receptacle modules. These various devices interactively cooperate to produce remote control of a variety of selectable power circuits, such as lamps, in response to operator instruction uniquely entered into the transmitter module control switch arrangement.

Radio Shack Division, Tandy Corp. (Ft. Worth, Tex.) provides several forms of remote control switch devices, including a model 61-2667 Wireless RF Remote Control Switch that includes a plug-in lamp controller and a hand-held, battery operated remote control that includes two pushbuttons which may serve to remotely turn the lamp controller on or off at considerable distance. Technology of this controller is based upon a Motorola application specific integrated circuit (ASIC) family, typically including the MC145026 encoder and MC145027 decoder thereby providing secure and reliable digital signal sequence based operation.

Stanley Works Inc. (Hartford, Conn.) makes a line of LIGHTMAKER[™] home control units that includes a model 370-2749 or 370-2551 Home Control transmitter unit and a model 370-2475 Wall Switch Module that together enable remote control of a remote electric power load, such as a lamp.

X-10 (U.S.A.) Inc. (Northvale, N.J.) produces a line of POWERHOUSE[™] modules including a model MC-460 transmitter and model LM-465 lamp module receiver. When a touchswitch is pressed on the transmitter a carrier current signal is sent to the receiver module that turns an attached load (such as a lamp) on and off in immediate response to a uniquely coded signal (from a possible combination of 256 different codes) produced by the transmitter that is keyed by the selected touch switch.

A common thread through all of these prior devices is the necessity for an operator to enter a control command into a transmitter, usually as a pushbutton switch action which then initiates a uniquely coded wireless signal (albeit sometimes "carrier current" coupled) that transmits to any remote receivers in the system, with the result that any compatible receiver having a predetermined matching code sensitivity will respond and turn an associated power load on or off.

I have realized that in certain residential settings it might be, for example, more convenient to merely "turn-on" a usual switch which may be integral with or part of an existing "principal" table lamp or other such "load" which then might remotely and automatically turn on one or more separately located "loads", such as other table lamps located elsewhere in a room or even a television receiver or other such device. In this setting, it is preferable that operation of the wireless transmitter/receiver connection is essentially transparent to the user. I have found that sensing change in the state of power flow through a primary power circuit such as that served by the mentioned manually switched principal table lamp may produce a signal that is conditioned to develop a uniquely coded transmitter pulse that serves to activate any number or remote control receiver units that have been preset to respond to the transmitter code signal, all without any special effort on the part of the user aside from the customary act of merely turning the usual switch built into the table lamp on or off.

I have furthermore envisioned my resulting invention as preferably embodied as a module that may plug into a wall receptacle and includes a socket that accepts a plug associated with the operator switched load, such as the mentioned principal table lamp. When the principal table lamp is turned on the state change brought about by the increased current flow produces a usually brief coded carrier current signal that activates one or more suitably preturned receiver modules that may correspondingly turn on other lamps, etc. Conversely, when the table lamp is turned off the resulting state change caused by cessation of current flow briefly produces a differently coded carrier current signal that serves to deactivate each of the one or more responsively pretuned receiver modules, thereby subsequently turning off the other lamps. It is noteworthy that no special user command action is necessary to enable the remote receivers other than the mere turn-on or turn-off of the principal table lamp through utilizing its usual switch. It shall also be understood that "inverse" operation is also taught, that being where the operating mode is such that when the principal table lamp is turned-on, the remote lamp or other load may be automatically turned-off.

SUMMARY

My invention utilizes wireless coupling of a signal between a transmitter module and one or more responsively preturned receiver modules to enable remote control of several ancillary loads whenever immediate state of power flow through a principal load is changed by intentional action of an operator such as might be accomplished through "turn-on" or "turn-off" of an ordinary switch which feeds power to the principal load. For example, a common table lamp might simply be "turned-on" by a person entering a room and as a result of that quite ordinary action, one or more remotely located lamps may simultaneously be turned-on.

Whenever power flow to a principal load, such as the mentioned lamp, is intentionally state-changed (such as by manual turn-on or turn-off) the change in state is sensed by circuits unique to my invention which produce a signal that immediately emits a brief, albeit uniquely coded, wireless signal. Such a wireless signal might be a radio frequency signal coupled through the power line and sometimes referred to as a carrier current. Also it is known practice to produce a wireless signal as a radio frequency signal coupled between antennae, an ultrasonic signal or even an infrared light signal. In any event, the wireless signal is typically accepted by a receiver module which is pretuned to the unique signature of the coded wireless signal. As a result of the occurrence of the wireless signal, albeit brief in duration, the receiver module acts as a remote switch which in turn may turn-on or turn-off a remote or secondary load.

In my usual embodiment, I utilize known carrier current responsive devices such as elements comprising transmitter and receiver components of any one of the several mentioned representative wireless control systems made by Leviton, Stanley, X-10(U.S.A.), or others. My embodiment might also utilize wireless RF coupling, such as that intrinsic with the Radio Shack controller. I teach how the transmitter portion of such systems is modified to include additional elements important to my invention's enhanced operation. Notably, this includes a current flow state sensor that detects the instant state of current flow between an a.c. power source and a principal a.c. load. More importantly, this state sensor particularly responds to a change in the state of current flow between the a.c. power source and the a.c. load such as might be wrought by turn-on or turn-off of an intervening switch. This state change signal then activates a timing function which simultaneously enables the transmitter portion of the master module, permitting a coded wireless signal to be emitted for a predetermined and usually short period of time, typically of about 1 second duration and hereinafter referred to as a "burst". The state change indicting principal a.c. load turn-on is preferably established to develop a wireless signal burst different from that produced by a turn-off state change. As a result of the uniquely coded signal bursts, ordinary receiver modules typically associated with the mentioned systems may be remotely turned-on or turned-off in immediate response to switched change in the state of current flow between the a.c. source and the principal a.c. load.

I continue to teach several neat approaches for obtaining the state change signal in the principal a.c. load circuit. I utilize the voltage drop developed across forward biased power diodes to develop a suitable signal, which might be further stepped-up by a transformer. I also show use of a thyristor which is retarded, albeit slightly, in delayed turn-on during the a.c. power cycle in order to develop the necessary state change signal together with essential d.c. power source needs for the attendant solid state circuitry which develops the wireless signal. I also show use in "three terminal" and "two terminal" primary a.c. power circuit hookups, whereby the two terminal hookup might be utilized to replace a common a.c. power wall switch. I additionally show how a turn-off coded wireless signal burst may be produced although all a.c. power flowing to the transmitter module is interrupted by an a.c. power switch situated between the a.c. power source and the transmitter module.

My invention also provides for remote module operation which may effect delayed turn-off in response to the unique wireless turn-off signal burst. This benefits a user by allowing remote lights (which might represent the remote loads) to remain on for a usually brief period of time, say 1 to 5 minutes or so, in order to provide safe passage through an area before the area is plunged into darkness.

It is therefore the purpose of my invention to produce remote turn-on or turn-off of a secondary a.c. load in response to change in power flow coupled between an a.c. power source and a primary a.c. load produced by operator activated action of a switch ordinarily associated with the principal a.c. load.

An object of my invention is to provide a master transmitter module that responds to switched current flow state change through a first a.c. circuit to produce a uniquely coded wireless signal burst for each condition of turn-on and turn-off of the first a.c. circuit.

A further object of my invention is to include one or more remote receiver modules which respond to the uniquely coded wireless signal burst produced by the master transmitter module and as a result corresponding turn-on and turn-off current flow through a second a.c. circuit.

Still another intent of my invention is to enable operation of the master transmitter module in "two terminal" circuit hookups, such as those typically associated with common electric power wall switches, where only one side of the a.c. circuit wiring is available for all power and signal injection purposes.

Yet another goal of my invention is to provide a remote receiver module that delays turn-off of the second a.c. circuit subsequent to having received a coded wireless turn-off signal burst from the master transmitter module.

It is these and other unique advantages of my invention herein described which shall serve to describe the essence of my teaching that is encompassed by the attendant claims.

DESCRIPTION OF DRAWINGS

I depict my invention on 11 sheets of drawings, therefor including 12 figures.

DESCRIPTION OF MY INVENTION

Figure 1:
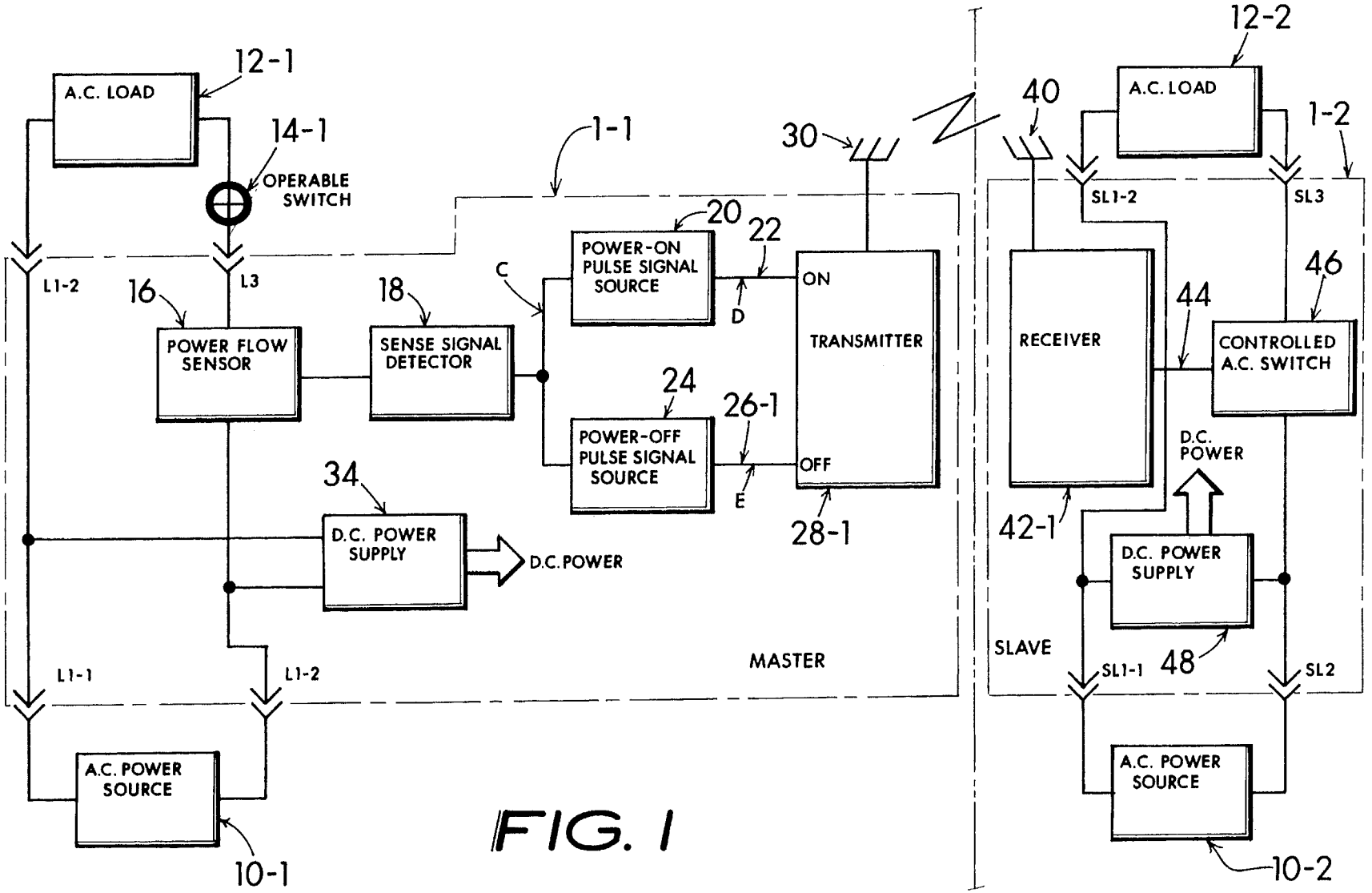
FIG. 1—Block diagram for essential elements of one form of my invention.

In FIG. 1 I show a master control module 1-1 wireless coupled with a slave module 2-1. The master module 1-1 includes a power flow sensor 16 that couples serially with an a.c. power source 10-1, an operable switch 14-1 and a primary a.c. load 12-1. When the operable switch 14-1 is "open", no current flows through the circuit to the a.c. load 12-1 with the result that the power flow sensor 16 develops an off-state signal that couples with the sense signal detector 18. The instant the operable switch 14-1 is turned-on, the power flow sensor 16 immediately develops an on-state signal that couples with the sense signal detector 18. It is this change between the off-state and the on-state that couples with the power-on pulse signal source 20 that enables development of a pulse signal on line 22 that enables the "ON" signal line of the transmitter 28-1. As a result, the transmitter 28-1 produces a wireless signal, albeit brief in duration and hereinafter sometimes called a signal burst, that couples between the depicted transmitter antenna 30 and the receiver antenna 40. As a result, the signal delivered by the antenna 40 to the receiver 42-1 develops a signal on line 44 that turns-on the controlled a.c. switch 46 that serially couples between an a.c. power source 10-2 and an ancillary a.c. load 12-2 enabling a.c. power flow therebetween.

Conversely when the operable switch 14-1 is turned-off, the change between the on-state and the off-state that couples with the power-off pulse signal source 24 enables development of a pulse signal on line 26 that enables the "OFF" signal line of the transmitter 28-1. As a result, the transmitter 28-1 produces a unique wireless signal burst that couples between the antenna 30, 40. As a result the signal delivered by the antenna 40 to the receiver 42-1 develops a signal state on line 44 that turns-off the controlled a.c. switch 46 thereby interrupting power flow between the a.c. power source 10-2 and the ancillary a.c. load 12-2.

D.c. power for the master control module 1-1 circuitry is produced by a d.c. power supply 34, while d.c. power for the slave module 2-1 circuitry is produced by a separate d.c. power supply 48.

Figure 2:
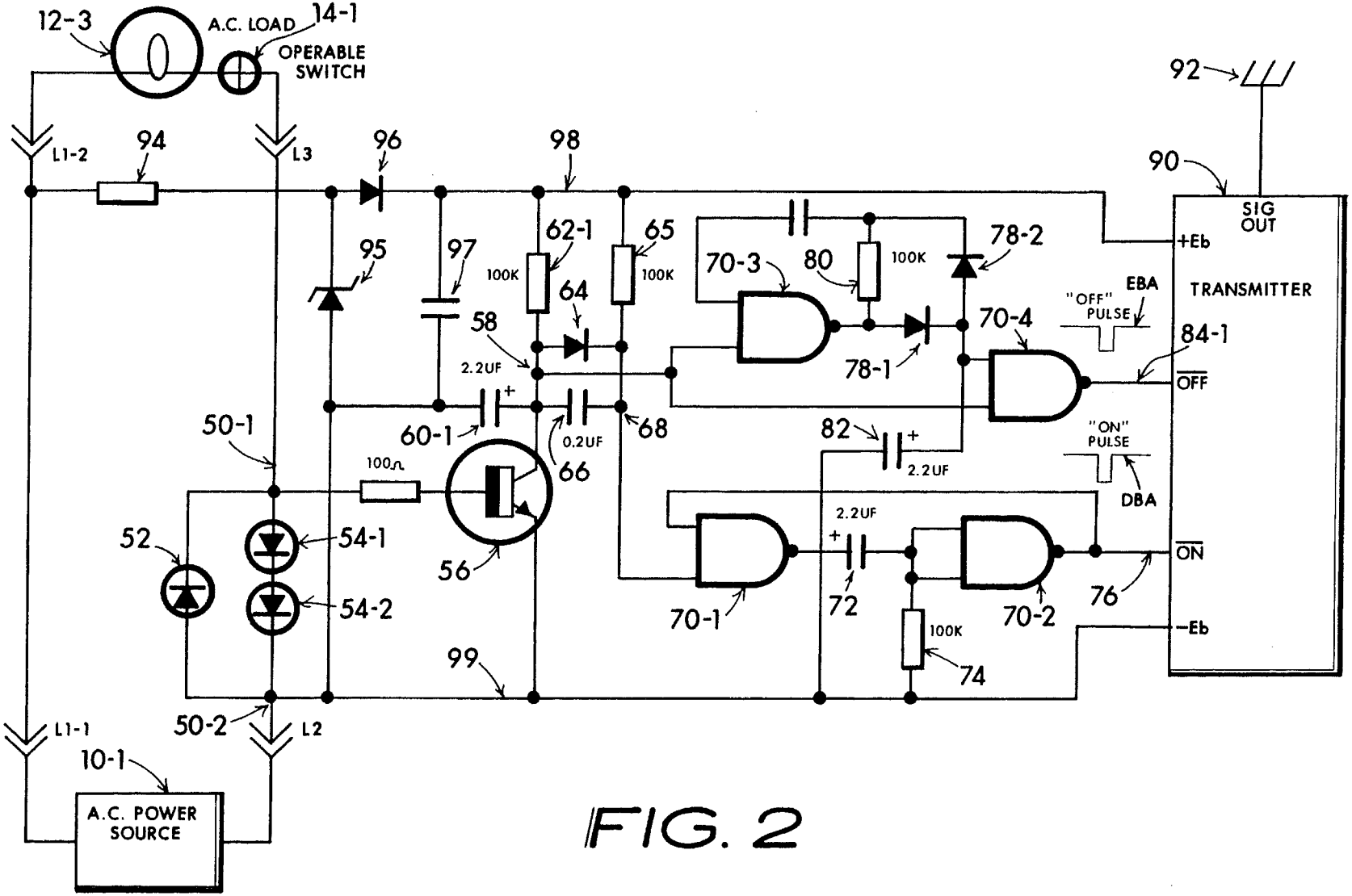
FIG. 2—Circuit diagram for a portion of the master shown in FIG. 1.

A schematic for a preferred form for my invention appears in FIG. 2 to include a primary a.c. load 12-3, which might be an incandescent light for example, seriately coupled with the operable switch 14-1 and the a.c. power source 10-1 (which might be commercial utility power). Intercoupling between the source and the load is obtained via connections L1-1,L1-2 for one side, whilst the other side intercouples via connections L2,L3. An arrangement of diodes, including a diode 52 inverse parallel coupled with a series coupled pair of diodes 54-1,54-2, are collectively series coupled between the terminals L2,L3 and effective to develop a voltage drop thereacross as a result of any substantial current flow which might occur between the a.c. power source 10-1 and the a.c. load 12-3 when the operable switch 14-1 is "closed". Ordinarily substantially prior to switch 14-1 closure, current may flow through resistor 94 and diode 96 to charge capacitor 97 and develop a d.c. voltage on line 98 that is limited to about the zener breakdown level of diode 95 minus the forward voltage drop developed across diode 96. As a result of the d.c. voltage developed between line 98 and common line 50-2, capacitor 60-1 will be charged through resistor 62-1 to develop a substantial positive voltage level on juncture 58 that may couple through diode 64 with an input of NAND gate 70-1, typically a CMOS type CD-4011B or CD-4093 integrated circuit.

Closure of the operable switch 14-1 causes half-cycle current flow through the series arrangement of diodes 54-1, 54-2. This developed forward conduction voltage drop (typically about 1.4 peak volts) appears between lines 50-1,50-2 and couples through a resistor with a base terminal of a NPN transistor 56, forward biasing the transistor "ON". Conduction through the transistor abruptly saturates the transistor collector to emitter circuit, and discharging the capacitor 60-1, quickly diminishing the signal level which appeared at juncture 58. This rapid drop in juncture 58 signal level also couples through a capacitor 66 developing a short duration negative pulse on line 68 connected to the input of the NAND gate 70-1 before the capacitor 66 is charged through resistor 65. The result is that the NAND gate 70-1 output state drives HIGH and this level couples through capacitor 72 with inputs of NAND gate 70-2, developing a LOW state on the NAND gate 70-2 output line 76 which couples with the other input of NAND gate 70-1 thereby latching the NAND gate pair and maintaining the LOW state on line 76 until capacitor 72 is charged through resistor 72 whereupon the state on line 76 again returns HIGH. Typically this results in a negative pulse on line 76 having a duration of about 100 milliseconds which may couple with the /ON input of the transmitter 90, thereby initiating the signal burst from the transmitter that may couple through antenna 92 with any number of responsively tuned slave modules to effect turn-on of remote load circuits.

During the preceding state conditions, whereas the state level on juncture 58 was maintained LOW as coupled with an input of NAND gate 70-3, the output state of the gate is driven HIGH resulting in current flow through diode 78-1 that charges capacitor 82. Also, the LOW state at juncture 58 couples with an input of NAND gate 70-4, maintaining the gate output state HIGH on line 84 that couples with the /OFF input of the transmitter 90.

Opening the operable switch 14-1 stops current flow through the diodes 52,54-1,54-2 and as a result, transistor 56 remains OFF throughout the a.c. power cycles. As a result, the level on juncture 58 immediately assumes a HIGH state as charge accumulates in capacitor 60-1 through resistor 62-1. The immediate result is that the state of both inputs of NAND gate 70-4 are momentarily HIGH, resulting in a LOW state level on line 84 that activates the /OFF input of the transmitter 90 developing the signal burst which may couple through the antenna 92 with the slave modules to effect remote load turn-off. The duration of the LOW state signal on line 84 is about 100 milliseconds, remaining only until capacitor 82 is discharged through resistor 80 and diode 78-2 to the LOW state on the gate 70-3 output.

Figure 3:
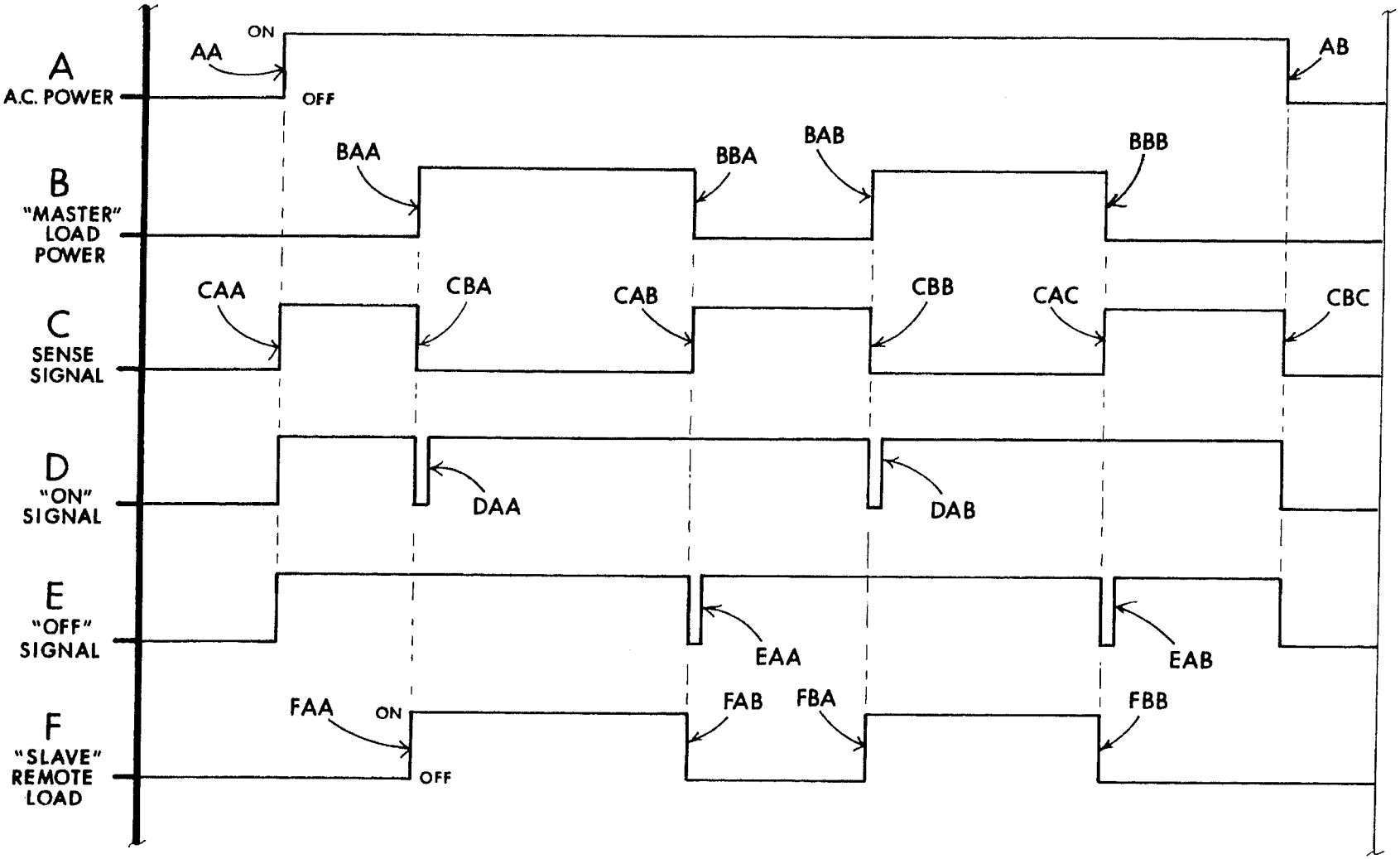
FIG. 3—Waveforms associated with circuit of FIG. 2.

Waveforms depicted in FIG. 3 illustrate the signal states found in the circuitry of FIG. 2. Waveform A depicts the application of a.c. power from the source 10-1. In other words, the ON state between the rising edge AA and falling edge AB merely depicts the connection of or removal of the source 10-1 from the rest of the circuit. MASTER load power on/off states is depicted in waveform B. When the operable switch 14-1 is closed, the master load 12-3 power commences flowing, as shown by rising waveforms BAA or successive turn-on rise BAB. Conversely, opening the switch 14-1 results in the falling waveform edge BBA or BBB respectively.

When a.c. power is coupled with the circuit concurrent with the switch 14-1 being open, the sense signal waveform C rises CAA,CAB,CAC as measured at the circuit juncture 58 (e.g., the transistor 56 collector, etc.) due to charge accumulation in capacitor 60-1 as provided through resistor 62-1. When the master load power flow occurs through switch 14-1 closure, the level at the juncture 58 drops to a low level, depicted by waveform changes CBA,CBB,CBC.

Waveform D shows that concurrent with the flow of master load power and the drop in the sense signal level CBA,CBB an "ON" signal DAA,DAB is produced on line 76 which may serve to briefly and uniquely key the transmitter 90 to signal any interactive remote receiver modules to turn their controlled ancillary loads ON.

Waveform E shows that concurrent with the cessation of master load power flow and the increase of the sense signal level CAB,CAC an "OFF" signal EAA,EAB is produced on line 84 which may serve to briefly and uniquely key the transmitter 90 to signal any interactive remote receiver modules to turn their controlled ancillary loads OFF.

Waveform F shows that concurrent with the ON signal pulses DAA,DAB the "SLAVE" remote load is turned ON as depicted by waveform portions FAA,FBA whilst alternatively concurrent with the OFF signal pulses EAA,EAB the "SLAVE" remote load is turned OFF as depicted by waveform portions FAB,FBB.

Figure 4:
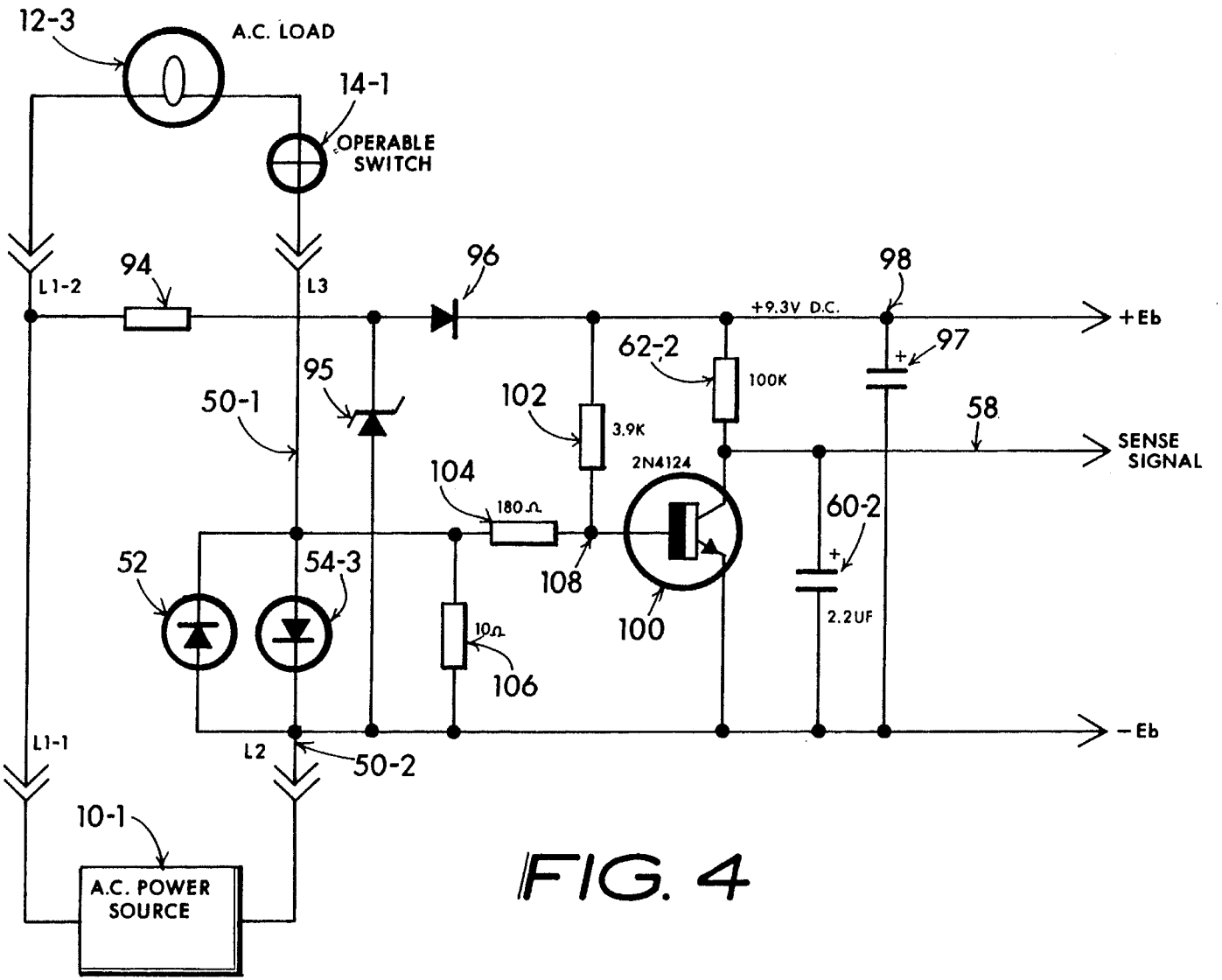
FIG. 4—Alternative current flow sensor circuitry detail.

A portional circuit is shown in FIG. 4 which has the goal of reducing parasitic power loss and resulting heating in the power flow sensing power diode arrangement. In this hookup, only two inverse parallel connected power diodes 52,54-3 are employed. This results in about +0.7 volt being developed between line 50-1 and line 50-2 during the "positive" a.c. power half cycle. This level is insufficient to turn-on the typical silicon NPN transistor 100. However, by arranging a pre-bias voltage divider including resistors 102, 104,106 it is possible to establish about 0.4 volts of prebias on the transistor, being low enough to keep the transistor turned off, but sufficient that when summed with the about +0.7 volts which may develop across forward conduction diode 54-3 can result in saturated turn-on of the transistor 100. The principal advantage of this arrangement is the elimination of one of the diodes 54-2 of the previous circuit. This means that 0.7 volts less drop is developed and in a circuit utilizing a load 12-3 that might draw 3 amperes this translates into about (0.7 V×3 A)/2=1.05 watts of less power dissipation which is an important consideration in modular devices, particularly when Underwriters Laboratory or equivalent approval is sought.

Figure 5:
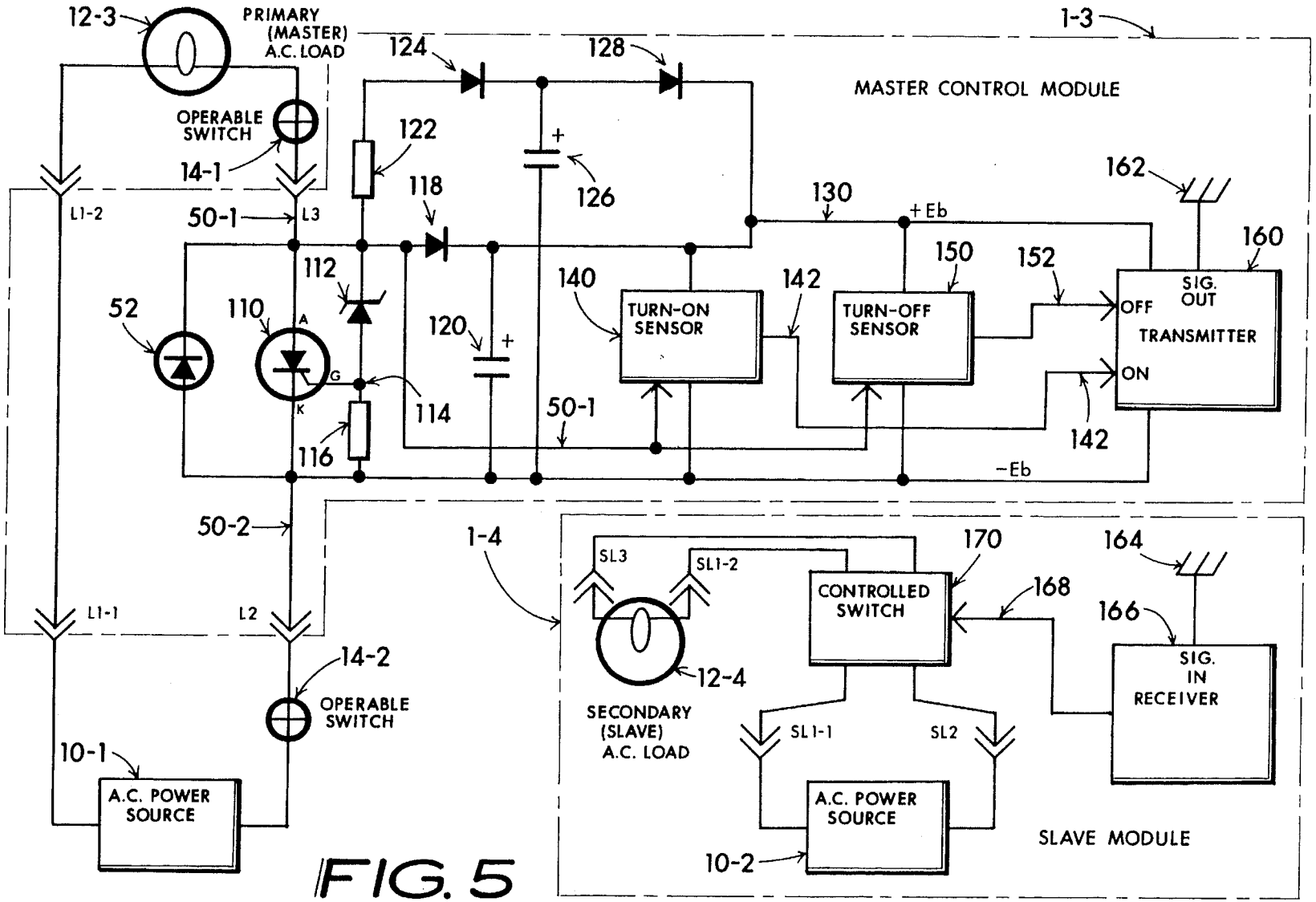
FIG. 5—Circuit diagram for a form of my invention responsive to power switching on either side of the master control device.

In FIG. 5 I show a master control module 1-3 with the diode 52 coupled inverse parallel with a silicon controlled rectifier thyristor 110, that together with zener diode 112, rectifier 118 and capacitor 120 provide a source of d.c. voltage on line 130 that generally follows the teaching of my earlier U.S. Pat. No. 4,300,090 of Nov. 11, 1981 for a "Direct Current Power Supply". This arrangement permits "two terminal" operation, whereby all operating power and signals are obtained from but one side of the a.c. power line, e.g. lines 50-1,50-2 alone. This permits operation where the common line connections L1-1,L1-2 may be unavailable, such as at a typical wall switch in residential applications and so forth. In any event, what occurs is that when either of the operable switches 14-1,14-2 (noting that one switch is connected "ahead of" the module 1-3 while the other switch is connected following the module relative with the source 10-1) are open no power flows to the master load 10-3. Conversely when both of the switches are closed, current flow through the circuit permits the positive level which may appear between the anode (A) and cathode (K) of the s.c.r. 110 to rise to a value where breakdown of the zener diode 112 occurs, whereupon gate current is injected into the s.c.r. gate (G) causing abrupt s.c.r. turn-on. In effect, during the "positive" half-cycle (when the s.c.r. anode is positive relative with the cathode), the voltage level between line 50-1 and 50-2 rises during the first few degrees of the half cycle to the zener breakdown voltage, whereupon subsequent to said s.c.r. conduction the level drops to about 1 volt or less throughout the remainder of the half-cycle. Further said, if the zener diode 112 has a breakdown value of 10 volts, the level across the s.c.r. rises to nearly 11 volts (zener voltage plus gate to cathode drop of s.c.r.) before turn-on occurs. It is this value which is rectified to produce d.c. (+Eb) on line 130. This prebreakdown level also couples through resistor 122 and rectifier 124 to charge a capacitor 126, the value of which is usually many times larger than the value of capacitor 120. It is the purpose of this capacitor charge to continue to supply d.c. power to the remainder of the circuit via diode 128 ordinarily for about 100 milliseconds or more after either of the operable switches 14-1,14-2 are opened thereby providing sufficient d.c. power to enable the transmitter 160 to emit a turn-off signal burst to the associated slave module(s) 1-4.

The positive pulse signal which occurs between line 50-1 relative with line 50-2 prior to s.c.r. turn-on also couples with each the turn-on sensor 140 and the turn-off sensor 150. The turn-on sensor 140 responds to occurrence of a succession of pulse signals on line 50-1 and develops a signal on line 142 having typically a pulse duration of about 100 milliseconds which couples with the ON input of the transmitter 160 to develop a signal burst from the transmitter that may couple through antennae 162,164 with a receiver 166 in the slave module 1-4. The receiver subsequently develops a responsive signal on line 168 that "turns-on" a controlled switch (perchance a triac thyristor) to effect coupling of a.c. power between the source 10-2 and the slave load 12-4, in this arrangement via the terminal connections SL1-1,SL1-2,SL2,SL3. Conversely, the turn-off sensor 150 responds to the change from a succession of pulse signals on line 50-1 to that of no pulse signals, whereupon a signal is developed on line 152 having a typical pulse duration of about 100 milliseconds which couples with the OFF input of the transmitter 160 to develop a coded signal burst from the transmitter that may couple with the slave module receiver to effect turn-off of the controlled switch and disconnection of the slave load 12-4 from the a.c. power source 10-2. Sufficient d.c. power is stored in capacitor 126 to maintain transmitter 160 and other circuit element operation for the duration of the "turn-off" signal burst.

Figure 6:
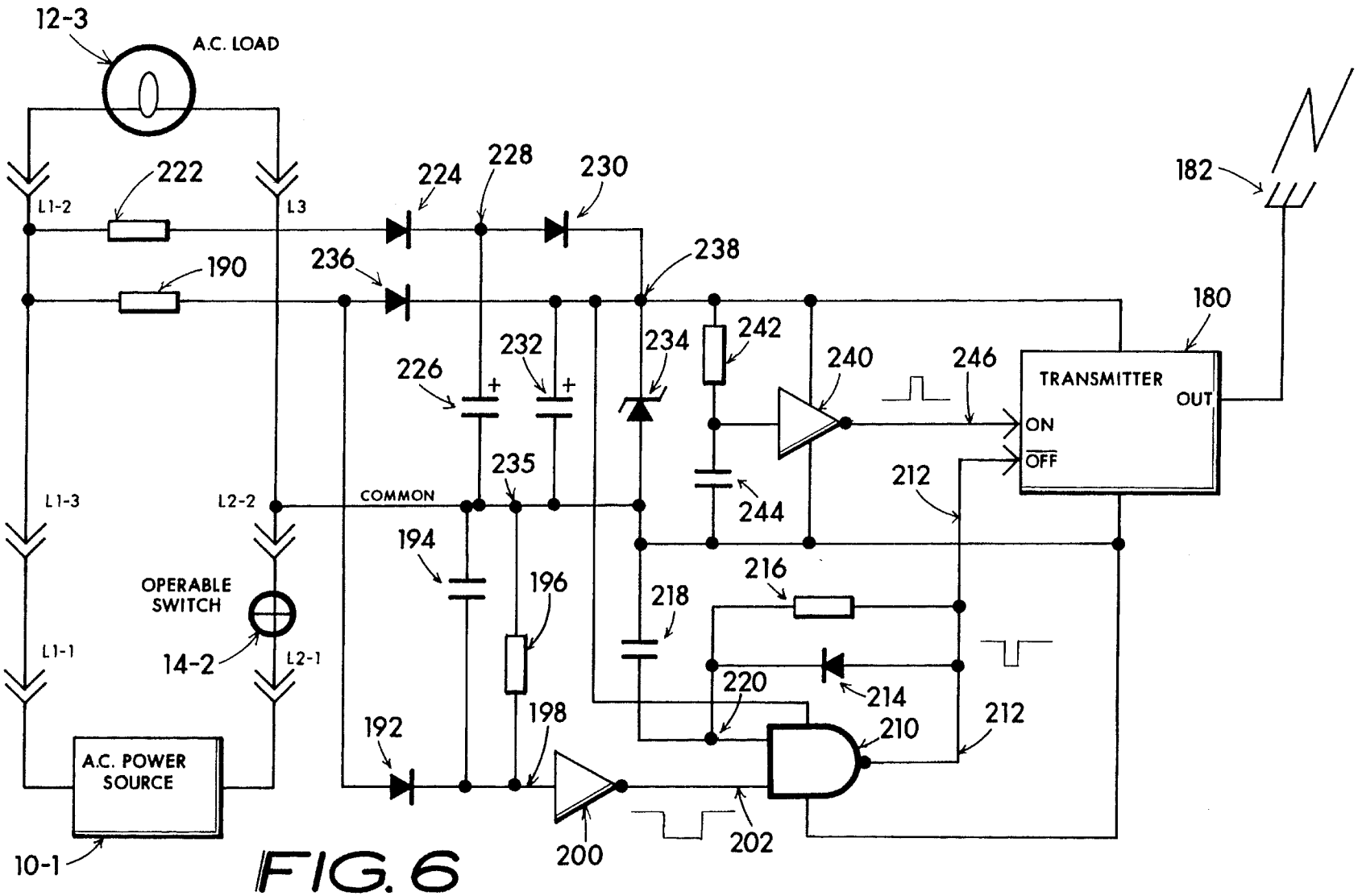
FIG. 6—Circuit diagram for a form of my invention responsive to voltage turn-on/off in the master circuit in lieu of current flow sensing.

In FIG. 6 I show an arrangement for my invention whereby circuit operation is determined from a.c. voltage developed between the two sides of the a.c. line connections L1-3,L2-2 instead of through sensing circuit current flow as in the preceding arrangements. In this hookup, a voltage dropping resistor 190 together with a rectifier diode 236 serve to charge a capacitor 232 to produce d.c. power on line 238 which is shunt regulated by a zener diode 234 relative with the common line connection 235. A voltage dropping resistor 222 and rectifier diode 224 also serve to charge a (ordinarily much larger value) capacitor 226 to develop a d.c. level associated with juncture 228.

The increase in d.c. voltage on line 238 (relative with line 235) when the operable switch 14-2 is initially closed slowly charges capacitor 244 through resistor 242 the juncture of which couples with an inverter 240 (for example ⅙ of a CD-4069 or ¼ of a CD-4011). Initially, the inverter input state is effectively LOW (until capacitor 244 charges) resulting in a HIGH state signal on line 246 preferably having a duration of about 100 milliseconds or so that couples with the ON input of the transmitter 180 serving thereby to key the transmitter to produce a coded burst signal which is delivered to the antenna 182 to couple with associated slave modules (not shown).

When the operable switch 14-2 is closed, the a.c. signal delivered through resistor 190 is also steered through diode 192 to quickly charge a capacitor 194 (preferably during the first encountered half-cycle) thereby developing a HIGH state on line 198 coupled with the input of an inverter 200. The result is a LOW state from the inverter which jams an input of NAND gate 210 thereby forcing the gate output state unconditionally HIGH. The resulting HIGH state on line 212 couples through diode 214 to charge capacitor 218 thereby developing a HIGH state on line 220 coupled with the other NAND gate 210 input. Immediately when the operable switch 14-2 is opened, charging of capacitor 194 ceases and the capacitor immediately discharges through resistor 196 (the combination ordinarily having a time constant of less than about 20 milliseconds or so). This results in a HIGH state on line 202 and in effect both input states of the NAND gate 210 are at this point HIGH, resulting in a LOW state on line 212 which may couple with the /OFF input of the transmitter 180 to effect a coded turn-off signal burst through the antenna 182 to effect remote control of any associated slave modules. To continue, the LOW state on line 212 causes delayed discharge of capacitor 218 through resistor 216 the combination of which have a time constant on the order of 100 milliseconds which serve to determine the duration of the turn-off signal on line 212 delivered to the /OFF input of the transmitter. Line 212 is driven to a HIGH state at the completion of the turn-off signal pulse when capacitor 218 is sufficiently discharged to cause the level on line 220 to appear as a LOW state to the NAND gate 210 input. Operation of the transmitter is assured by the energy stored in capacitor 226 which is coupled through diode 230 with the d.c. power connection line 238 although the operable switch has been opened and no further power is delivered through either of the rectifier diodes 224,236.

Figure 7:
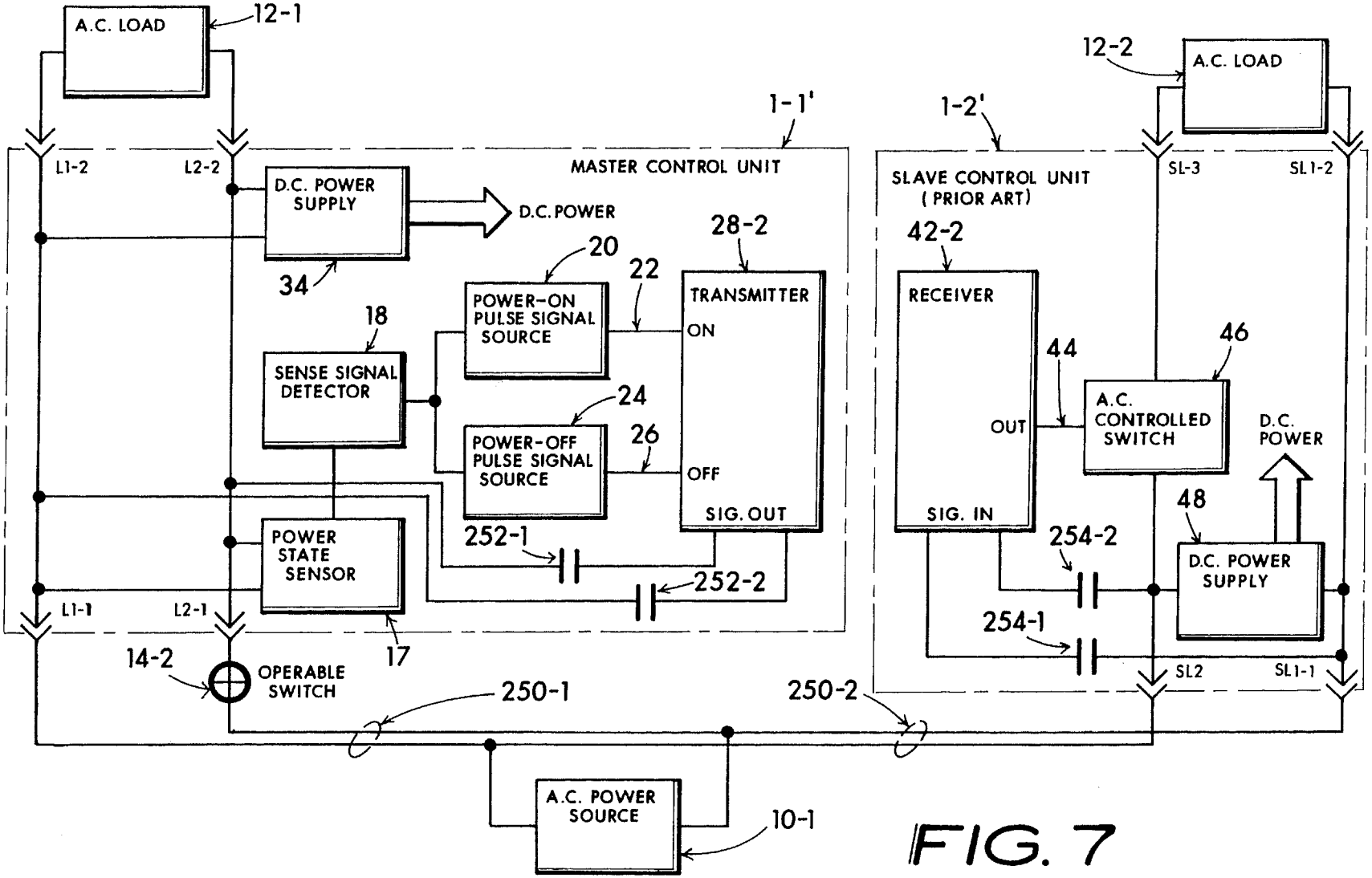
FIG. 7—A particular practicable form of my invention utilizing carrier current signal coupling.

In my preceding examples for my invention, signal coupling between the master module and the slave module(s) has been suggested using wireless transmission which might include radio frequency emission, infra-red light or ultrasonic tones. In FIG. 7 I show utilization of carrier current connection whereby a common a.c. power line connection 250-1,250-2 is tied betewen the master module 1-1', the slave module(s) 1-2' and the a.c. power source 10-1. Operation of the circuit elements comprising the master control unit 1-1' is similar to that described for the arrangement of FIG. 1. The principal difference in this hookup concerns the transmitter 28-2 which is shown to produce an output signal (which delivers the turn-on and/or turn-off signal bursts) that couples through capacitors 252-1,252-2 with the two sides of the a.c. power line L1-1,L2 thereby effecting signal coupling through the operable switch into the common a.c. power wiring 250-1. Although switch 14-2 may be opened, sufficient capacitive coupling ordinarily exists across the switch to permit sufficient coupling of the relatively high frequency (e.g., usually several hundred kilohertz) control signal burst. The high frequency control signal burst on common wiring lines 250-1,250-2 may then couple through capacitors 254-1,254-2 with the signal inputs of the receiver 42-2 to effect control of the a.c. controlled switch 46 by the signal developed on line 44 as said earlier for FIG. 1 operation.

Figure 8:
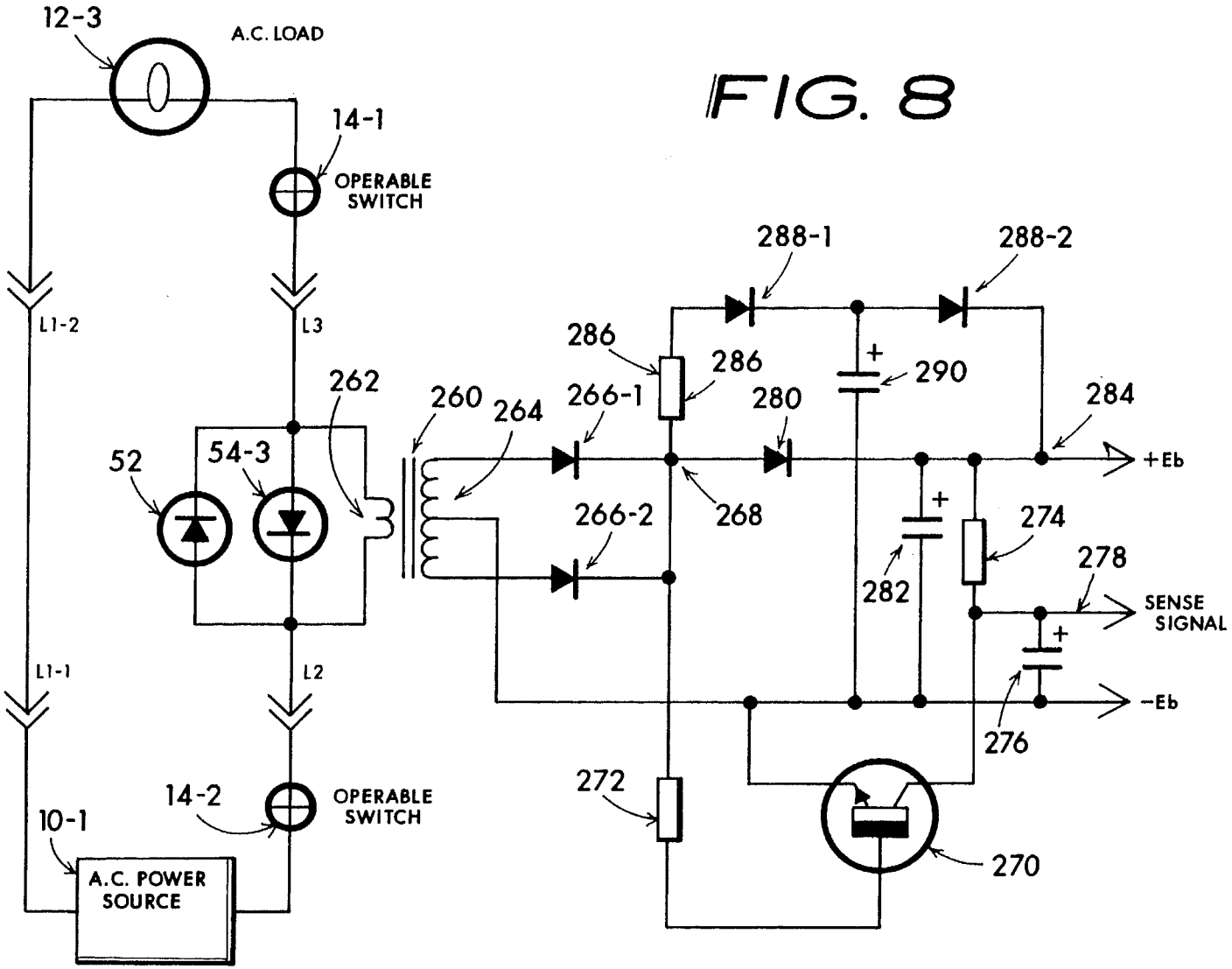
FIG. 8—Partial schematic utilizing a current transformer to produce d.c. power requirements and on/off sense signal.

In FIG. 8 I show a power supply and control signal circuit which borrows from my earlier U.S. Pat. No. 4,948,987 issued Aug. 14, 1990 for "Secondary Electric Power Source Produced by Current Flow through a Primary A.C. Power Circuit". Two inverse coupled diodes 52,54-3 develop about 1.4 volts peak-to-peak voltage thereacross when the operable switches 14-1,14-2 are closed and current flows through the circuit between the source 10-1 and the load 12-3. This 1.4 volt p-p signal level couples with a transformer 260 primary winding 262 and is subsequently stepped-up to a higher level secondary winding 264 level. I have successfully utilized a common "audio output" transformer having a 500 ohm centertapped primary and 8 ohm secondary impedance, whereby the transformer is hooked in reverse: that is the 8 ohm secondary winding serves as the primary winding 262 in my circuit. A type 42MC001 transformer provided by Mouser Electronics Inc., Mansfield, Tex. is typical of such a device. The suggested transformer exhibits about a 1:7.9 step-up primary to secondary, resulting in about 11 volts p-p across the secondary (e.g., about 5.5 volts p-p in each secondary half). The secondary voltage is rectified by diodes 266-1,266-2 and coupled through diode 280 to charge capacitor 282 to deliver d.c. power +Eb on line 284. Also, the rectified voltage at juncture 268 couples through resistor 286 and diode 288-1 to charge capacitor 290. The functions of capacitors 282,290 correspond with respective capacitors 232 and 226 of the circuit of FIG. 6.

In this circuit, the pulsating rectified signal appearing at juncture 268 also couples through resistor 272 with the base of a NPN transistor 270. The pulsating base signal corresponding pulses the collector of the transistor as coupled with the sense signal juncture 278. Reviewing the operation of the circuit of FIG. 2 it shall be understood that operation of the collector circuit portion associated with the transistor generally opeates in a similar manner. In other words, resistor 274 corresponds with resistor 62-1 and capacitor 276 corresponds with capacitor 60-1, while juncture 278 corresponds with juncture 58. The remainder of the circuit is not depicted in FIG. 8 but may be obviously extended from the teaching of FIG. 2.

Figure 9:
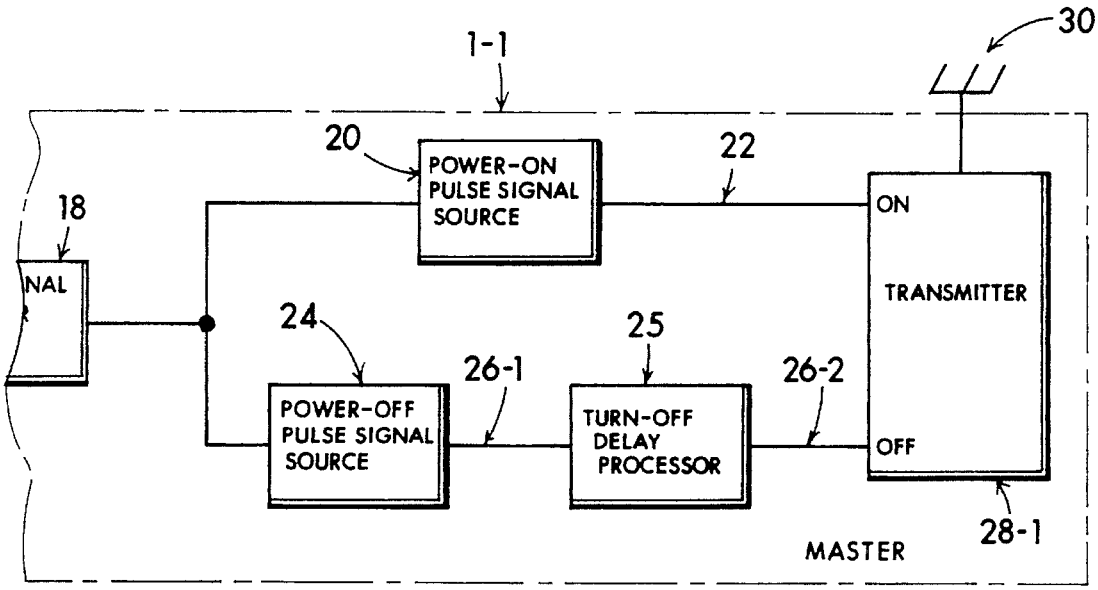
FIG. 9—Block diagram showing inclusion of a turn-off delay in the power-off signal path.

I have found advantage in delaying remote turn-off of the controlled slave load in order to permit passage through a controlled area or exit from a room having controlled lighting. A delay of a few minutes is ordinarily more than adequate. In FIG. 9 I show a Turn-Off Delay element 25 hooked into my earlier shown MASTER control 1-1 of FIG. 1. The POWER-OFF pulse produced by the power-off pulse signal source 24 on line 26-1 couples with the turn-off delay 25 and after an elapse of time, perhaps on the order of 1–2 minutes, a power off pulse is produced on line 26-2 that couples with the OFF input of the transmitter 28-1 thereby signalling turn-OFF of the remotely controlled A.C. Load 12-2 as tuaght earlier relative with FIG. 1.

Figure 10:
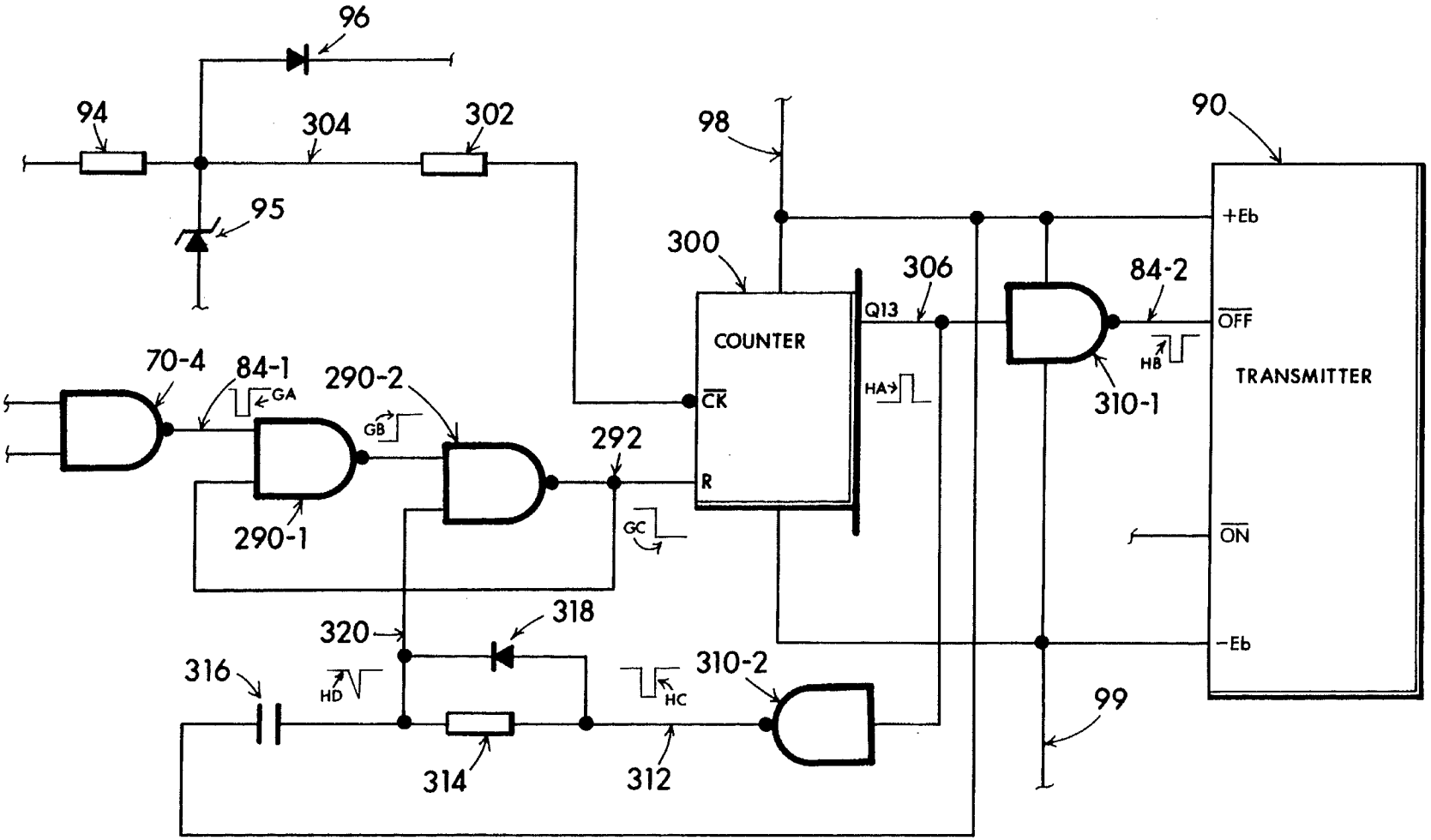
FIG. 10—Circuit for providing turn-off delay of the turn-off signal as associated with the circuit of FIG. 2.

In FIG. 10 I depict an example of a delayed turn-OFF control function as might be implemented relative with the earlier circuit of FIG. 2. The OFF pulse signal delivered by NAND gate 70-4 on line 84-1 herein couples with an input of NAND gate 290-1 that together with NAND gate 290-2 are cross coupled to provide a bistable flipflop function. As a result, the pulse on line 84-1 "sets" the flipflop latch, thereby delivering a LOW state on line 292 that couples with the RESET input of a 14-stage counter 300 (e.g., a CD4020 integrated circuit or the like). Line frequency pulses developed at the juncture 304 of resistor 94, zener diode 95 and rectifier 96 couple through resistor 302 with the clock input /CK of the counter 300. As a result, the counter advances states and subsequent to 8,191 clock pulses the counter Q13 output line 306 state drives HIGH. With a 60 hertz clock frequency, 8,191 clock pulses represents about 2.27 minutes of elapsed time. The HIGH state on line 306 is inverted through gate 310-1 to develop the OFF pulse signal on line 84-2 that may drive the /OFF input of the transmitter 90 to signal turn-off of a remotely controlled a.c. load. The HIGH state on line 306 also couples through inverter 310-2 to develop a LOW state on line 312 that charges capacitor 316 through resistor 314, typically over a period of a fraction of a second. When the charge accumulated in capacitor 316 rises sufficiently, the state level on line 320 (as coupled to an input of the gate 290-2) will drive sufficiently LOW to reset the flipflop latch and returning the state signal on line 292 again HIGH, resetting the counter 300 thereby driving the counter output signal line 306 state LOW and terminating the OFF pulse signal level on line 84-2. The LOW state on line 306 also drives the state of line 312 HIGH which immediately discharges capacitor 316 through diode 318.

Figure 11:
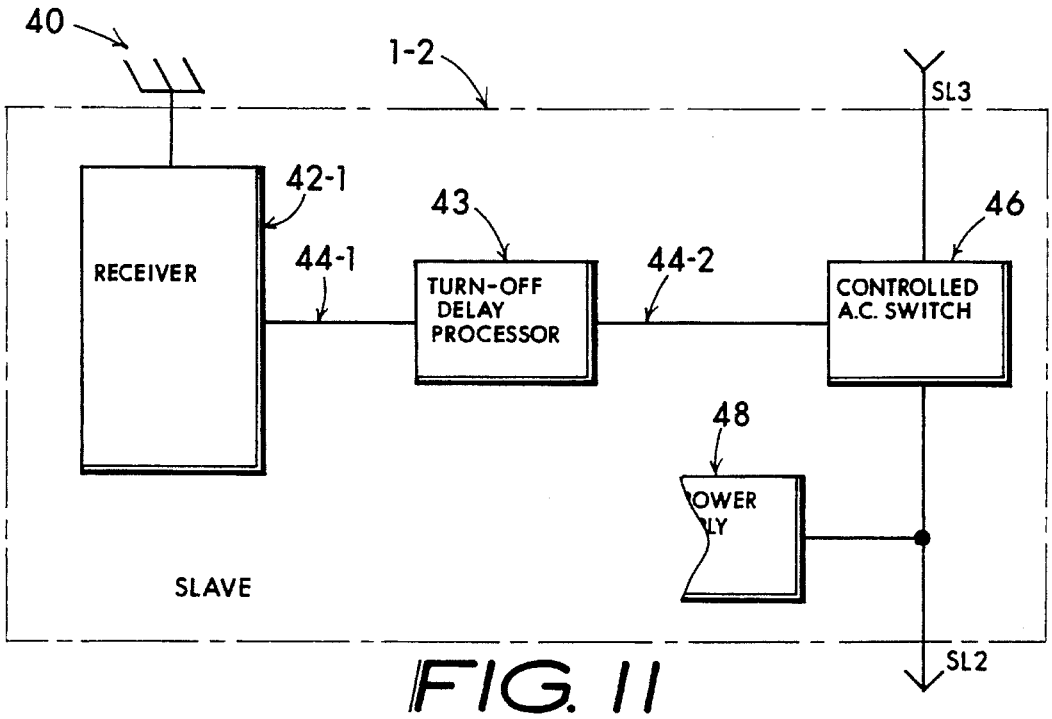
FIG. 11—Block diagram showing power-off delay to be produced at the slave module.

While the advantage afforded by delaying production of the OFF pulse signal at the transmitter is that ordinary prior art receivers may be used, it is also reasonable that the turn-off delay might be implemented immediately at the receiver as shown in FIG. 11, depicting modification of the SLAVE module 1-2 of FIG. 1. The received signal on line 44-1 is now shown to be coupled through a turn-OFF signal delay processor 43 that may have the unique characteristic of delaying any turn-OFF signal that might otherwise couple through it between the receiver 42-1 and the controlled switch 46. Ordinarily, turn-ON signals on line 44-1 might immediately couple through the processor 43 to line 44-2 where they might turn-ON the controlled switch 46. However, turn-OFF pulses which might appear on line 44-1 are delayed for 1–2 minutes, more or less, before they attain a level of efficacity on line 44-2 that might turn-OFF the controlled switch 46. A recognized advantage of delaying turn-OFF control at the slave module is that where several slaves modules might be used in concert, some of them might be utilized to produce instant turn-OFF control while others might have delayed turn-OFF control characteristics depending upon the unique requirements of the task at hand.

Figure 12:
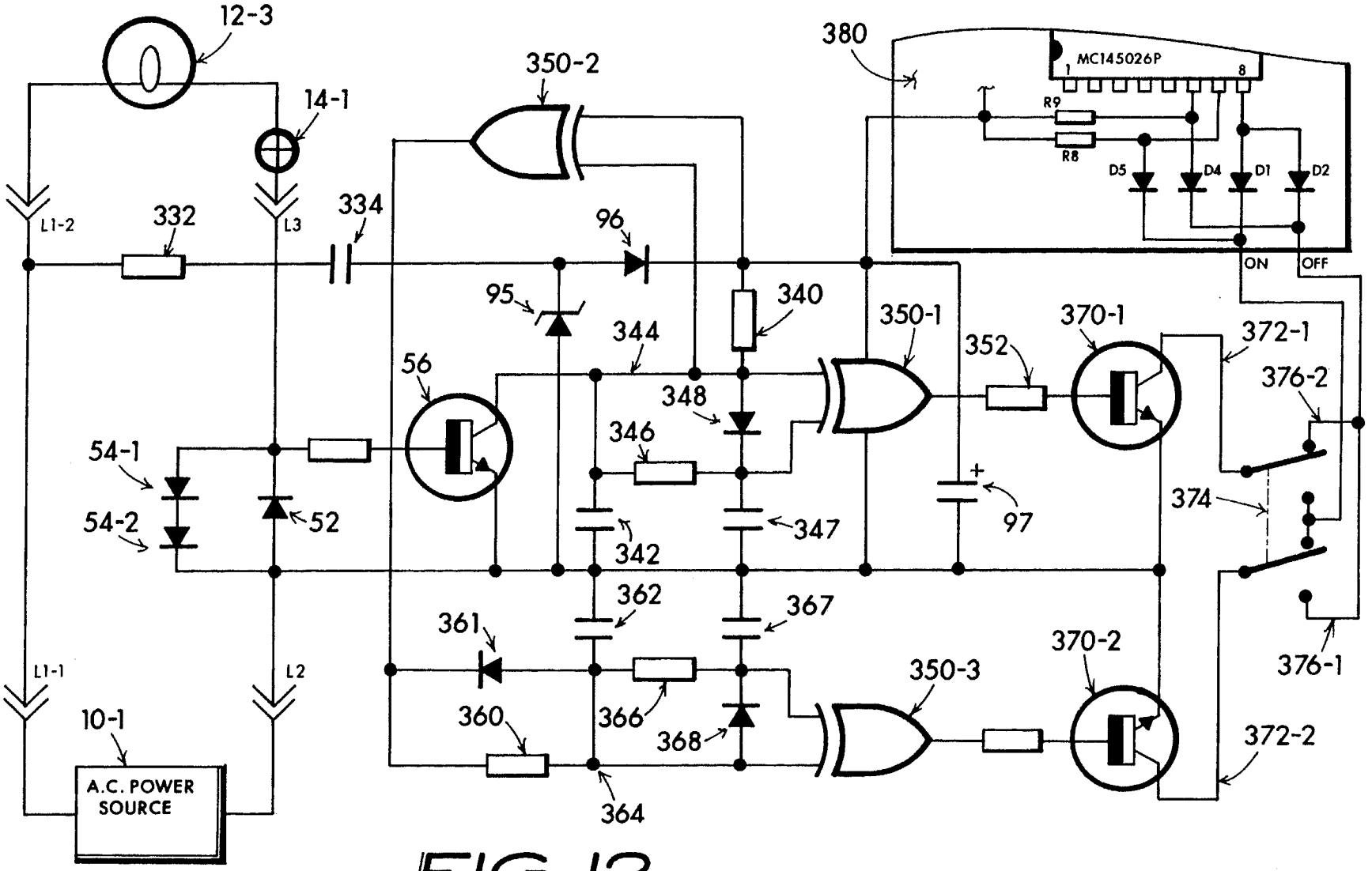
FIG. 12—Circuit diagram for a form of my invention particularly adapted to operate in conjunction with prior art apparatus typified by the Radio Shack model 61-2667 remote control switch.

The Radio Shack 61-2667 Remote Control Switch may be adapted to operate with my invention, as shown in FIG. 12. The remote control device provided with the Radio Shack controller is modified to include the necessary automatic control features of my invention. As shown, the transistor 56 is "pulsed" whenever current flows through the a.c. power circuit, which ordinarily occurs when switch 14-1 is closed and the load 12-3 is turned-on (e.g., coupled to the a.c. power source 10-1). Initially, with the switch 14-1 "open" the transistor 56 is maintained in an off state and current flow through resistor 340 charges capacitor 342 until the level on line 344 is effectively logic HIGH as coupled to the input of the OR gate 350-1. A diode 348 also couples this HIGH level to the other gate input. When the switch 14-1 is closed, current pulses developed at the collector of the transistor 56 immediately discharges capacitor 342, which means that the gate 350-1 input associated with line 344 goes logic LOW. However, the other input of the gate is briefly held HIGH due to the charge retained in capacitor 347 which must discharge through resistor 346 after an elapse of time. This non-equal state at the gate input causes the gate output to briefly rise HIGH for the duration of the inequality, the time of which is determined mainly by the time constant of resistor 346 and capacitor 347 and might be on the order of a few seconds or less. The so described pulsed output signal from the gate 350-1 appearing on line 352 therefrom couples with and turns-on a NPN transistor 370-1.

The level state on line 344 is also coupled through another OR gate 350-2, operative as an inverter. When the switch 14-1 is turned-on, the LOW state which develops on the line 344 brings about a HIGH state at the output of the gate 350-2, thereby charging capacitor 362 through resistor 360 to develop a HIGH state on line 364 that also immediately charges capacitor 367 through diode 368 thereby maintaining both inputs of the OR gate 350-3 at substantially the same HIGH level. When switch 14-1 is opened, and the pulses developed through the transistor 56 cease, the line 344 charges to a HIGH state with the result that the output of the inverter hooked gate 350-2 drives to a LOW state. This change promptly discharges the capacitor 362 through diode 361, making the level on line 364 immediately LOW. However, the charge in capacitor 367 remains HIGH for a brief interval, the duration of which is determined by the discharge time constant of the resistor 366 relative with the capacitor 367 value. As a result, a short duration (ordinarily a few seconds or less) develops at the output of the OR gate 350-3 which couples with the transistor 370-2.

The collectors of the transistors 370-1, 370-2 may couple with a DPDT switch 374 hooked up as a "reversing switch" which is to say that, depending upon the switch "position", the collectors may be reversibly coupled with line 376-1 and line 376-2. These lines represent junctures on the printed circuit board 380 (part no. 0412-474-0104B or an equivalent) ordinarily utilized in the Radio Shack 61-2667 remote control hand-held unit. The remote control typically utilizes a Motorola MC-145026P encoder (application specific integrated) circuit (ASIC). Line 376-1 couples through the prior art diode D4 to pin 6 of the ASIC while line 376-2 couples through the prior art diode D5 to pin 7 of the ASIC. At the same time the prior art diodes D1,D2 couple pin 8 of the ASIC (and other circuit portions now shown) effectively to "ground", i.e. the –Eb bus through whichever of the transistors 370-1 or 370-2 that might momentarily be turned-on. The purpose of the reversing switch 374 to selectively enable either turn-on of the remote load when the master load is turned-on, or else turn-off of the remote load when the master load is turned-on (and vice versa) thereby offering a feature of providing an additional level of functional flexibility and operational convenience for the user.

The elements comprising my remote control invention, when properly coupled to each other, have been shown to operate successfully as herein described utilizing the key components and circuit arrangement depicted in the several drawings. Standard types of integrated circuits, such as CMOS logic circuits, can readily satisfy the various gate, inverter, flip-flop and counter requirements. You shall realize that the parameters and values which I particularly show are given by way of example only to assist a person of average skill in the art to duplicate the fruits of my invention for experimental purposes only, and are not intended to limit in any way the scope of my invention.

Having thus described my invention in terms of a preferred embodiment thereof, which is set forth in some detail, it should be understood that this is by way of illustration only of the practicability of my disclosed device and that the invention is not necessarily limited thereto. Alternative embodiments and operating techniques will become apparent to engineers and other persons skilled in the art in view of my disclosure and, accordingly, it is contemplated that numerous modifications can be made in the apparatus by the skilled artisan without departing from the spirit of my herein described invention.

What I claim is:

1. Power control method comprising steps of:

seriately coupling a first circuit including a source of alternating current (a.c.) power, an operable switch, a power flow sensor and a first a.c. load;

utilizing the operable switch to enable and interrupt power flow through the first circuit;

sensing state of power flow through the first circuit;

producing a first control pulse signal in response to the sensing of an onset of substantial power flow through the first circuit as a result of closing the operable switch;

sending the first control pulse signal as a first wireless control signal;

receiving the first wireless control signal; and, enabling a seriately coupled second circuit including the source of a.c. power, a second a.c. load and a remote control switch which is responsive to the received first wireless control signal.

2. Power control method of claim 1 comprising further steps of:

producing a second control pulse signal in response to an interruption of the sensed state of power flow through the first circuit as a result of opening the operable switch;

sending the second control pulse signal as a second wireless control signal;

receiving the second wireless control signal; and, disabling the second circuit including the remote control switch in response to the received second wireless control signal.

3. Power control method of claim 1 whereby said sensing of the state of power flow through the first circuit comprises the further step of utilizing the power flow sensor to sense current flow between at least the source of a.c. power and the first a.c. load.

4. Power control method of claim 3 whereby said sensing of the current flow through the first circuit comprises the further step of sensing an instant level of forward voltage drop which develops across a semiconductor junction seriately coupled with elements comprising the first circuit.

5. Power control method of claim 4 whereby the level of forward voltage drop which develops across the semiconductor junction is in part determined by the further steps of:

providing the semiconductor junction as a thyristor having gate control of state of forward current flow therethrough;

maintaining forward conduction state of the semiconductor junction at a substantially high off-state impedance for an initial portion of successive a.c. power cycles;

deriving a source of direct current (d.c.) power from the forward voltage drop which may develop across the high off-state impedance of the semiconductor junction; and, gating the semiconductor junction into a state of substantially low on-state impedance in response to an instant voltage level increase of the a.c. power cycle about a predetermined level.

6. Power control method of claim 1 whereby said sensing state of power flow through the first circuit comprises the further step of utilizing the power flow sensor to sense a state of terminal potential essentially coupled between the source of a.c. power and the first a.c. load.

7. Means for remotely changing a state of power flow through a second circuit in response to a sensed change in a state of power flow through a first circuit and therefor comprising:

a source of alternating current (a.c.) power;

first a.c. circuit means including a first a.c. load means and operable switch means seriately coupled with the source of a.c. power;

second a.c. circuit means including a second a.c. load means and remote control switch means seriately coupled with the source of a.c. power;

means for sensing the state of a.c. power flow through the first a.c. circuit means;

means for determining change in the sensed said state of a.c. power flow;

means for producing a first control pulse signal in response to a first level to second level shift in the determined change;

means for sending the first control pulse signal as a first wireless control signal; and, means for remotely receiving the first wireless control signal and coupling it with the remote control switch means to establish a first state of power flow through the second a.c. circuit means.

8. Means of claim 7 further comprising:

means for producing a second control pulse signal in response to a second level to first level shift in the determined change;

means for sending the second control pulse signal as a second wireless control signal; and, means for remotely receiving the second wireless control signal and coupling it with the remote control switch to establish a second state of said power flow through the second a.c. circuit means.

9. Means of claim 7 further comprising:

semiconductor junction means seriately coupled with the first a.c. circuit means; and, said means for sensing state of a.c. power flow through the first a.c. circuit means comprising means responsive to a forward voltage drop which may develop across the semiconductor junction means as a result of the a.c. power flow therethrough.

10. Means of claim 7 wherein said means for sensing the state of a.c. power flow through the first a.c. circuit means comprises means responsive to an instant state of potential level of a.c. power coupled with and effectively applied across the first a.c. load means as usually determined by said operable switch means.

11. Means of claim 7 further comprising means for predetermining time duration of the first wireless control signal.

12. Means of claim 7 further comprising means for attaining carrier current coupling of the first wireless control signals between the sending means and the remote receiving means.

13. Means of claim 8 further comprising:

means for delaying the turn-off of the second a.c. circuit means said remote control switch means in response to the received second wireless control signal.

14. Means for remotely switching a state of alternating current (a.c.) power flow through a slave circuit in response to a sensed change in a switched state of a.c. power flow through a master circuit and therefor comprising:

a source of a.c. power;

means for seriately coupling a master circuit including the source of a.c. power, a master load means and an operable switch means;

means for seriately coupling a slave circuit including the source of a.c. power, a slave load means and a remote control switch means;

means for sensing and therefrom determining a change in state of a.c. power flow through the master circuit;

means for producing a first control pulse signal in response to a first level to second level shift in the determined change;

means for sending the first control pulse signal as a first wireless control signal; and, means for remotely receiving the first wireless control signal and coupling it with the remote control switch means to establish a first state of a.c. power flow through the slave circuit.

15. Means of claim 14 further comprising:

means for producing a second control pulse signal in response to a second level to first level shift in the determined change;

means for sending the second control pulse signal as a second wireless control signal; and, means for remotely receiving the second wireless control signal and coupling it with the remote control switch means to establish a second state of power flow through the slave circuit.

16. Means of claim 14 further comprising:

means seriately coupled with the master circuit whereby a voltage drop signal develops thereacross in response to the state of a.c. power flow through the master circuit; and, means responsive to substantial change in the developed voltage drop signal to produce the determination of change in state of a.c. power flow through the master circuit.

17. Means of claim 14 further comprising means responsive to an instant state of potential level of a.c. power coupled with the a.c. load means by the operable switch means and therefrom produce the determination of change which may occur in an immediate level of said a.c. power flow through the master circuit.

18. Means of claim 14 further comprising at least one of:

means for predetermining time duration of the wireless control signal; and, means for producing unique encoding of the wireless control signal.

19. Means of claim 15 further comprising:

means for producing delayed turn-off of the slave circuit said remote control switch means in response to the second wireless control signal.

20. Means of claim 14 further comprising means for reversing and thereby effecting reversed operational sense of at least the first wireless control signal producing means and the remote receiving means whereby turn-on of the operable switch means may enable turn-off the remote control switch means.

* * * * *